US006112044A

United States Patent [19]

Thompson et al.

[11] Patent Number: 6,112,044

[45] Date of Patent: Aug. 29, 2000

[54] INTEGRATED TONER TRANSPORT/TONER CHARGING DEVICE

[75] Inventors: Michael D. Thompson, Rochester; Heiko Rommelmann, Webster, both of N.Y.

[73] Assignee: Xerox Corporation, Stamford, Conn.

[21] Appl. No.: 09/313,313

[22] Filed: May 17, 1999

[51] Int. Cl.[7] ..... G03G 15/08

[52] U.S. Cl. ..... 399/285

[58] Field of Search ..... 399/285, 286, 399/290, 291, 289, 53, 55

[56] References Cited

U.S. PATENT DOCUMENTS 5,717,986 2/1998 Vo et al. ..... 399/291

*Primary Examiner*—William Royer

*Assistant Examiner*—Hoan Tran

*Attorney, Agent, or Firm*—Lloyd F. Bean II

[57] ABSTRACT

An apparatus for developing a latent image recorded on an imaging surface, including a housing defining a chamber storing a supply of developer material including toner; a donor member, spaced from the imaging surface, for transporting toner on the surface thereof to a region opposed from the imaging surface, said donor member includes an electrode array on the outer surface thereof, said array including a plurality of spaced apart electrodes extending substantial across width of the surface of the donor member; a multiphase voltage source operatively coupled to said electrode array, the phase being shifted with respect to each other such as to create an electrodynamic wave pattern for moving toner particles to and from a development zone; and a charging device for charging toner on the surface of said donor member.

6 Claims, 11 Drawing Sheets

INTEGRATED TONER TRANSPORT/TONER CHARGING DEVICE

This invention relates generally to a development apparatus for ionographic or electrophotographic imaging and printing apparatuses and machines, and more particularly is directed to an apparatus and method for loading dry Xerographic toner onto a traveling wave grid, charging toner and developing a latent electrostatic image.

INCORPORATION BY REFERENCE

The following is specifically incorporated by reference co-pending patent application, U.S. Ser. No. 09/312,873, D/98522, and U.S. Ser. No. 09/312,872 D/98523 entitled "A MULTIZONE METHOD FOR XEROGRAPHIC POWDER DEVELOPMENT: VOLTAGE SIGNAL APPROACH", and "A METHOD FOR LOADING DRY XEROGRAPHIC TONER ONTO A TRAVELING WAVE GRID", respectively.

Generally, the process of electrophotographic printing includes charging a photoconductive member to a substantially uniform potential so as to sensitize the surface thereof. The charged portion of the photoconductive surface is exposed to a light image from either a scanning laser bean or an original document being reproduced. This records an electrostatic latent image on the photoconductive surface. After the electrostatic latent image is recorded on the photoconductive surface, the latent image is developed. Two component and single component developer materials are commonly used for development. A typical two component developer comprises magnetic carrier granules having toner particles adhering triboelectrically thereto. A single component developer material typically comprises toner particles. Toner particles are attracted to the latent image forming a toner powder image on the photoconductive surface, the toner powder image is subsequently transferred to a copy sheet, and finally, the toner powder image is heated to permanently fuse it to the copy sheet in image configuration.

The electrophotographic marking process given above can be modified to produce color images. One color electrophotographic marking process, called image on image processing, superimposes toner powder images of different color toners onto the photoreceptor prior to the transfer of the composite toner powder image onto the substrate. While image on image process is beneficial, it has several problems. For example, when recharging the photoreceptor in preparation for creating another color toner powder image it is important to level the voltages between the previously toned and the untoned areas of the photoreceptor.

In the application of the toner to the latent electrostatic images contained on the charge-retentive surface, it is necessary to transport the toner from a developer housing to the surface. A basic limitation of conventional xerographic development systems, including both magnetic brush and single component, is the inability to deliver toner (i.e. charged pigment) to the latent images without creating large adhesive forces between the toner and the conveyor which transport the toner to latent images. As will be appreciated, large fluctuation (i.e. noise) in the adhesive forces that cause the pigment to tenaciously adhere to the carrier severely limit the sensitivity of the developer system thereby necessitating higher contrast voltages forming the images. Accordingly, it is desirable to reduce such noise particularly in connection with latent images formed by contrasting voltages.

In order to minimize the creation of such fluctuation in adhesive forces, there is provided, in the preferred embodiment of the invention a toner conveyor including means for generating traveling electrostatic waves which can move the toner about the surface of the conveyor with minimal contact therewith.

Traveling waves have been employed for transporting toner particles in a development system, for example U.S. Pat. No. 4,647,179 to Schmidlin which is hereby incorporated by reference. In that patent, the traveling wave is generated by alternating voltages of three or more phases applied to a linear array of conductors placed abut the outer periphery of the conveyor. The force F for moving the toner about the conveyor is equal QE t where Q is the charge on the toner and E t is the tangential field supplied by a multi-phase AC voltage applied to the array of conductors.

In that Patent, toner is presented to the conveyor by means of a magnetic brush which is rotated in the same direction as the traveling wave. This gives an initial velocity to the toner particles which enables toner having a much lower charge to be propelled by the wave. Typical approaches in the past have used a magnetic brush to load toner to the traveling wave grid. These approaches will mechanically wear the traveling wave device at the loading zone (grinding at a stationary loading zone on the grid). These approaches are also limited in the amount of toner they expose to stripping because the magnetic brush tips tend to be sparse for large brush spacing and the stripping field on the traveling wave grid decreases exponentially with distance from the grid surface. The methods to increase the amount of toner loaded to the grid (with the magnetic brush in this mode) include speeding up the magnetic roll, decreasing the spacing, increasing the loading zone length, and increasing the number of rolls. These methods all will result in increased wear on the grid.

Fluidized beds have been used to provide a means for storing, mixing and transporting toner in certain single component development systems and loading onto developer rolls. Efficient means for fluidizing toner and charging the particles within the fluidized bed are disclosed in U.S. Pat. No. 4,777,106 and U.S. Pat. No. 5,532,100, which are hereby incorporated by reference. In these disclosures, corona devices are embedded in the fluidized toner for simultaneous toner charging and deposition onto a receiver roll. While the development system as described has been found satisfactory in some development applications, it leaves something to be desired in the way in applications requiring the blending of two or more dry powder toners to achieve custom color development. Also, it has been found in the above systems that there are frequently disturbances to the flow in the fluidized bed associated with charged particles in the high electric fields surrounding corona devices immersed in the reservoir. Also, wire contamination present a reliability issue.

Triboelectric charging (contact electrification) of dry toners is a standard method used to electrically charge toner particles for development of latent electrostatic images. An alternate method to charge toners is via ion bombardment (Ion Charging) which offers many advantages, especially in applications to custom color where "in-situ" toner mixing is advantageous. Triboelectric charging of colored toners requires different additives dependent on toner color to achieve stable charging whereas ion charging of toners offers the advantage of charging toner particles based mainly on their size, independent of their intrinsic composition and surface structure. Triboelectric charging of toners also can create localized patches of charge on the toner particles which can lead to strong adhesion of these toners to various surfaces requiring special measures to remove them in the development, transfer and cleaning steps in the xerographic process. In the ion charging process, charged ions bombarding the toner particles are driven by the net field around the particles which tends to uniformly charge the toner, helping to decrease adhesion of these toners to donor or photoreceptor surfaces. One method to charge toner via ion bombardment involves fluidizing the toner and charging it using corona generation in close proximity to this fluidized bed.

Typical approaches in the past have used a magnetic brush to load toner to the traveling wave grid. These approaches will mechanically wear the traveling wave device at the loading zone (grinding at a stationary loading zone on the grid).

These approaches are also limited in the amount of toner they expose to stripping because the magnetic brush tips tend to be sparse for large brush spacing and the stripping field on the traveling wave grid decreases exponentially with distance from the grid surface. The methods to increase the amount of toner loaded to the grid (with the magnetic brush in this mode) include speeding up the magnetic roll, decreasing the spacing, increasing the loading zone length, and increasing the number of rolls. These methods all will result in increased wear on the grid.

At the development zone there are a number of issues which need to be addressed. When toner is presented to a latent electrostatic image in the development zone it is necessary to control the toner cloud height and speed at the entrance to the development zone. High quality development requires that the toner cloud be in a state which will enable it to be captured by fine details of the latent electrostatic image, the field lines of which are very local to the imaging surface. Toner transporting at too high a velocity or too close to the transport grid will not be developed to the image. The way we accomplish high quality development for mechanical donor roll powder cloud systems is to apply an AC field between the donor and the photoreceptor backplane to move the toner cloud closer to the image (donor AC).

However, noting the issues above the achievement of high reliability and simple, economic manufacturability of the system continue to present problems.

SUMMARY OF THE INVENTION

Briefly, the present invention obviates the problems noted above by utilizing an apparatus for loading and charging toner and developing an image. The development system of the present invention enables greater simplicity and latitudes in developing high quality, full color images with an image on image process. Furthermore, the present invention enables high speed development with a donor belt which makes possible a smaller development housing and printing machines.

There is provided an apparatus for developing a latent image recorded on an imaging surface, comprising a housing defining a chamber storing a supply of developer material comprising toner; a donor member, spaced from the imaging surface, for transporting toner on the surface thereof to a region opposed from the imaging surface, said donor member includes an electrode array on the outer surface thereof, said array including a plurality of spaced apart electrodes extending substantial across width of the surface of the donor member; a multiphase voltage source operatively coupled to said electrode array, the phase being shifted with respect to each other such as to create an electrodynamic wave pattern for moving toner particles to and from a development zone; and a charging device for charging toner on the surface of said donor member.

One aspect of the present invention is to load toner onto a traveling wave device in a manner which enables a maximum amount of charged toner to be accepted onto the device, for example, by cascading two component developer onto a grid from a two component developer source and allowing the beads with attached toner to tumble on the device, the toner being stripped from the carrier beads by the action of the field of the traveling wave and the mechanical force of collision of the developer beads with the surface of a traveling wave device. Another aspect of the present invention, is to use a traveling wave device to fluidize and transport toner through a corona generated by a solid state charging device to creating a compact, inexpensive and reliable manufactured unit to charge and transport toner. Application of the voltage will suspend and move toner along the grid in the direction appropriate to the charge of the toner and voltage signal applied to the grid. Toner is suspended while it is in motion on the grid and can be charged in transit by a charging device in the toner path.

Another aspect of the device is to use different zones on a traveling wave device to enable different voltage amplitudes and frequencies to be applied to different sections of the device. The addition to the traveling wave signal of a pure AC signal with zero phase shift between electrodes in the development zone and the backplane of the photoreceptor or electroreceptor, for example, will tend to give higher quality development for fine lines and light halftones.

Inasmuch as the art of electrophotographic printing is well known, the various processing stations employed in the printing machine will be shown hereinafter schematically and their operation described briefly with reference thereto.

Figure 1:
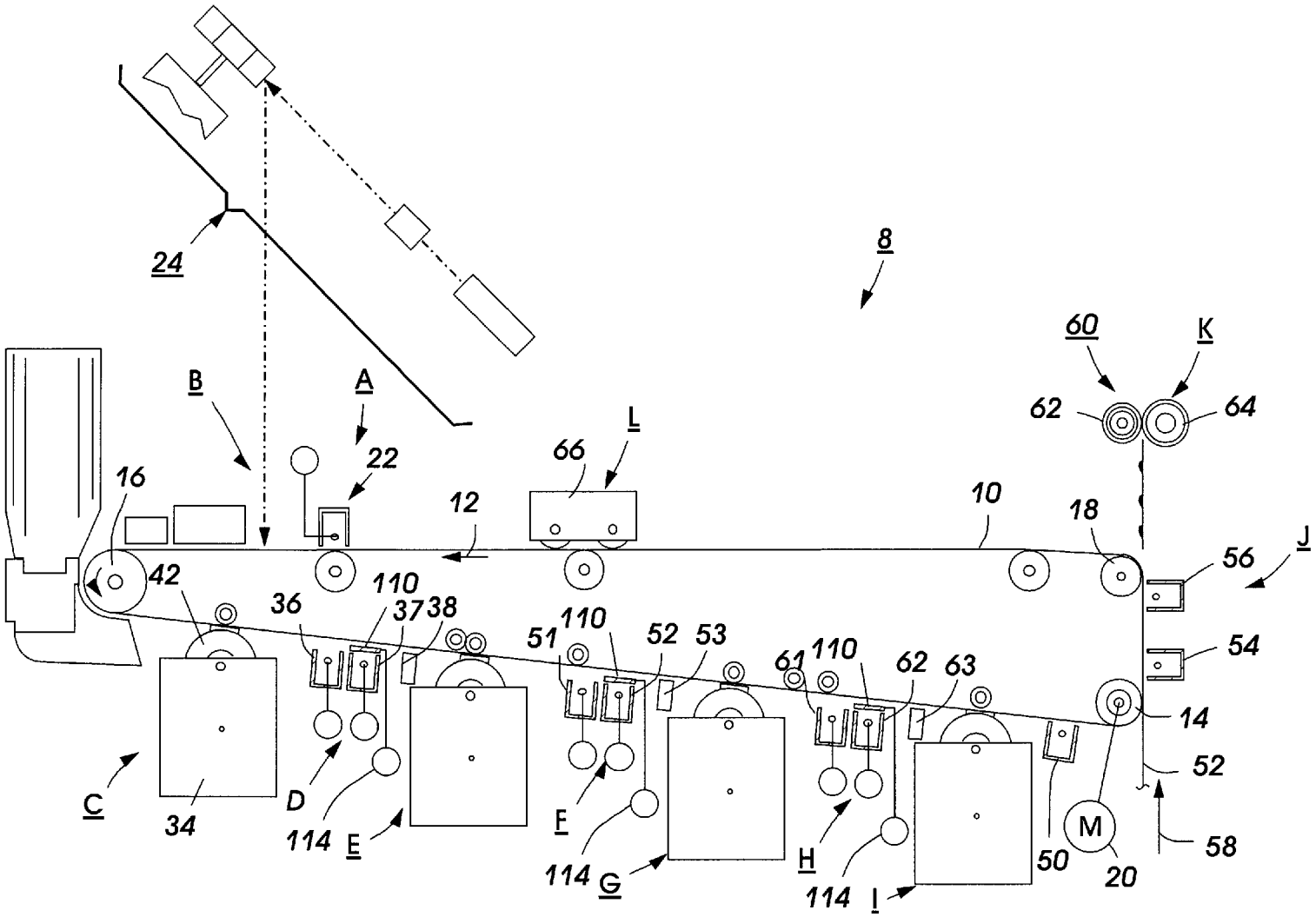
FIG. 1 is a schematic elevational view of an illustrative electrophotographic printing or imaging machine or apparatus incorporating a development apparatus having the features of the present invention therein.

Referring initially to FIG. 1, there is shown an illustrative electrophotographic machine having incorporated therein the development apparatus of the present invention. An electrophotographic printing machine creates a color image in a single pass through the machine and incorporates the features of the present invention. The printing machine uses a charge retentive surface in the form of an Active Matrix (AMAT) photoreceptor belt 10 which travels sequentially through various process stations in the direction indicated by the arrow 12. Belt travel is brought about by mounting the belt about a drive roller 14 and two tension rollers 16 and 18 and then rotating the drive roller 14 via a drive motor 20.

As the photoreceptor belt moves, each part of it passes through each of the subsequently described process stations. For convenience, a single section of the photoreceptor belt, referred to as the image area, is identified. The image area is that part of the photoreceptor belt which is to receive the toner powder images which, after being transferred to a substrate, produce the final image. While the photoreceptor belt may have numerous image areas, since each image area is processed in the same way, a description of the typical processing of one image area suffices to fully explain the operation of the printing machine.

Figure 2:
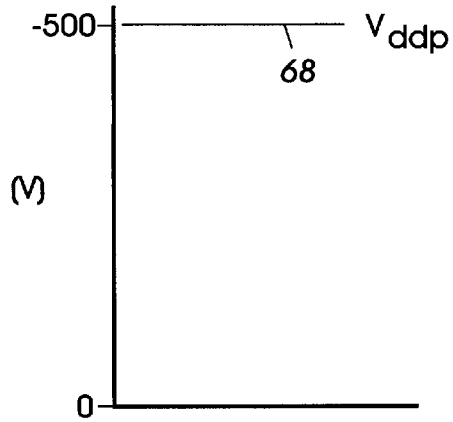
FIG. 2 shows a typical voltage profile of an image area in the electrophotographic printing machines illustrated in FIG. 1 after that image area has been charged.

As the photoreceptor belt 10 moves, the image area passes through a charging station A. At charging station A, a corona generating device, indicated generally by the reference numeral 22, charges the image area to a relatively high and substantially uniform potential. FIG. 2 illustrates a typical voltage profile 68 of an image area after that image area has left the charging station A. As shown, the image area has a uniform potential of about −500 volts. In practice, this is accomplished by charging the image area slightly more negative than −500 volts so that any resulting dark decay reduces the voltage to the desired −500 volts. While FIG. 2 shows the image area as being negatively charged, it could be positively charged if the charge levels and polarities of the toners, recharging devices, photoreceptor, and other relevant regions or devices are appropriately changed.

Figure 3:
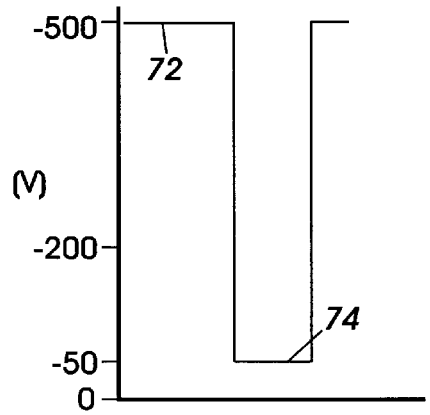
FIG. 3 shows a typical voltage profile of the image area after being exposed.
Figure 4:
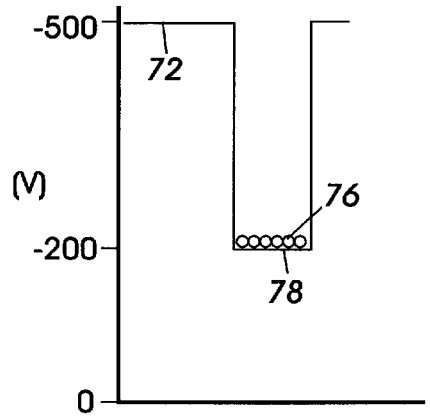
FIG. 4 shows a typical voltage profile of the image area after being developed.

After passing through the charging station A, the now charged image area passes through a first exposure station B. At exposure station B, the charged image area is exposed to light which illuminates the image area with a light representation of a first color (say black) image. That light representation discharges some parts of the image area so as to create an electrostatic latent image. While the illustrated embodiment uses a laser based output scanning device 24 as a light source, it is to be understood that other light sources, for example an LED printbar, can also be used with the principles of the present invention. FIG. 3 shows typical voltage levels, the levels 72 and 74, which might exist on the image area after exposure. The voltage level 72, about −500 volts, exists on those parts of the image area which were not illuminated, while the voltage level 74, about −50 volts, exists on those parts which were illuminated. Thus after exposure, the image area has a voltage profile comprised of relative high and low voltages.

After passing through the first exposure station B, the now exposed image area passes through a first development station C which is identical in structure with development system E, G, and I. The first development station C deposits a first color, say black, of negatively charged toner 76 onto the image area. That toner is attracted to the less negative sections of the image area and repelled by the more negative sections. The result is a first toner powder image on the image area.

Figure 9:
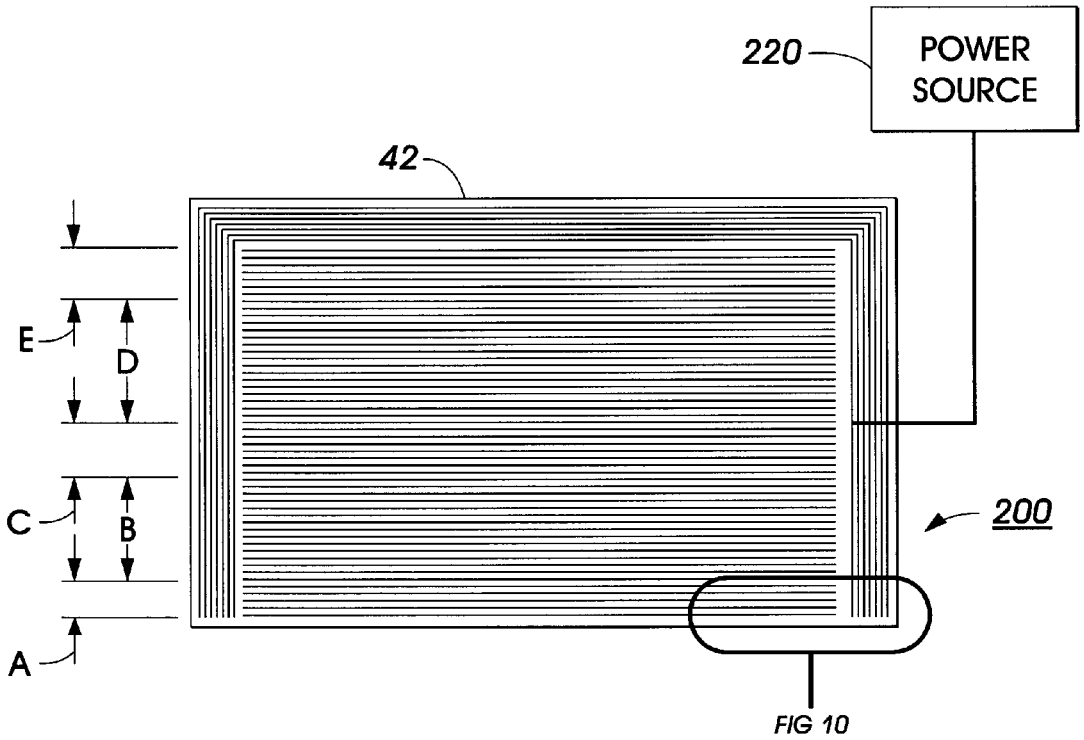
FIGS. 9 and 10 are top view of a portion of the flexible donor belt of the present invention.
Figure 10:
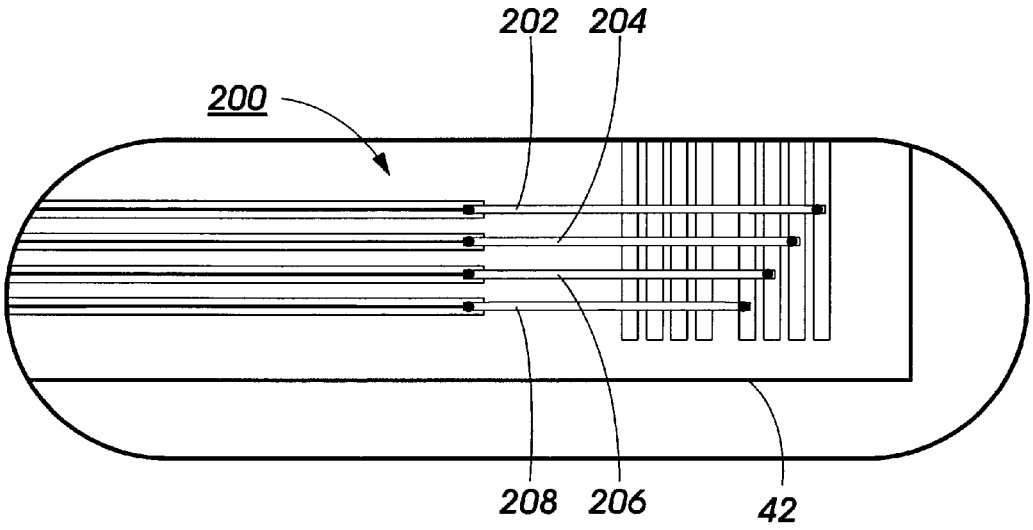
Figure 11:
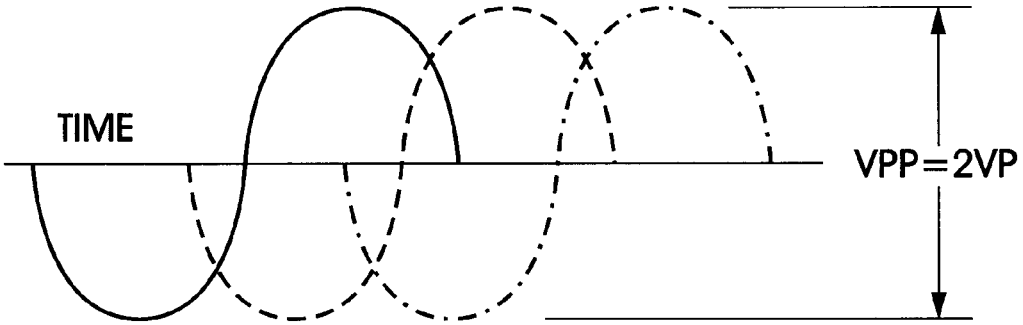
FIG. 11 PRIOR ART
FIGS. 11 and 12 are waveforms which can be employed with the present invention.
Figure 12:
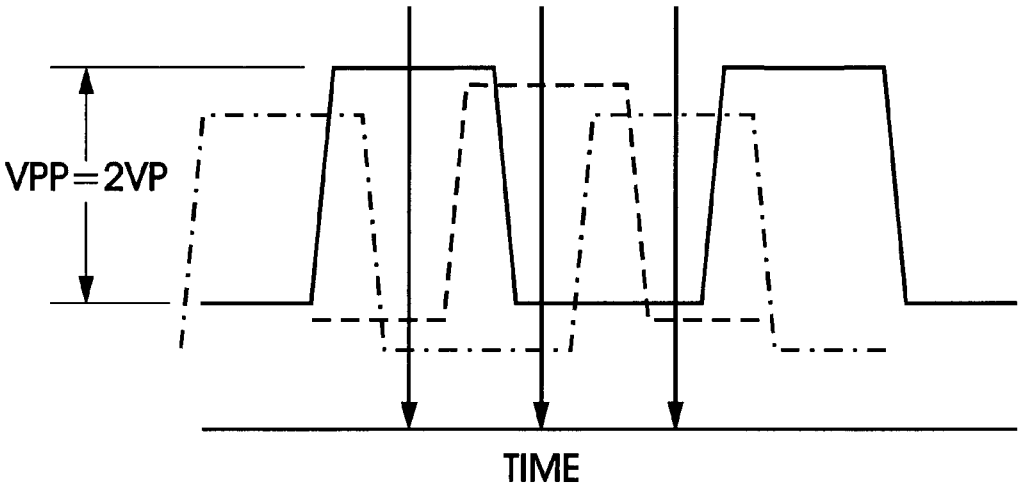

For the first development station C, development system 34 includes a flexible donor belt 42 having groups of electrode arrays near the surface of the belt. As illustrated in FIGS. 9–10, Electrode array 200 has group areas A–F in which each group area is individually addressable to perform the function of: Loading; Transferring; Developing; Transferring and Unloading. Each electrode array group area is independently addressable and operatively connected to voltage source 220 in order to supply a voltage in the order of 0–1000 volts AC or DC to each group area. The electrodes in array group area A picks up the toner from the developer bed 76 in FIG. 8 and transports it via the electrostatic wave set up by power trace (see FIG. 12). Electrode array group areas B and D connected to the voltage source via phase shifting circuitry (see FIG. 12) such that a traveling wave pattern is established. The electrostatic field forming the traveling wave pattern pushes the charged toner particles about the surface of the donor belt from the developer sump76 to the belt 10 where they are transferred to the latent electrostatic images on the belt by electrode group area C which generates a toner cloud in the development zone. Thereafter, toner is moved by electrode array group area D where electrode group area E is biased to unload remaining toner off the belt.

FIG. 3 shows the voltages on the image area after the image area passes through the first development station C. Toner 76 (which generally represents any color of toner) adheres to the illuminated image area. This causes the voltage in the illuminated area to increase to, for example, about −200 volts, as represented by the solid line 78. The unilluminated parts of the image area remain at about the level 72.

After passing through the first development station C, the now exposed and toned image area passes to a first recharging station D. The recharging station D is comprised of two corona recharging devices, a first recharging device 36 and a second recharging device 37, which act together to recharge the voltage levels of both the toned and untoned parts of the image area to a substantially uniform level. It is to be understood that power supplies are coupled to the first and second recharging devices 36 and 37, and to any grid or other voltage control surface associated therewith, as required so that the necessary electrical inputs are available for the recharging devices to accomplish their task.

Figure 5:
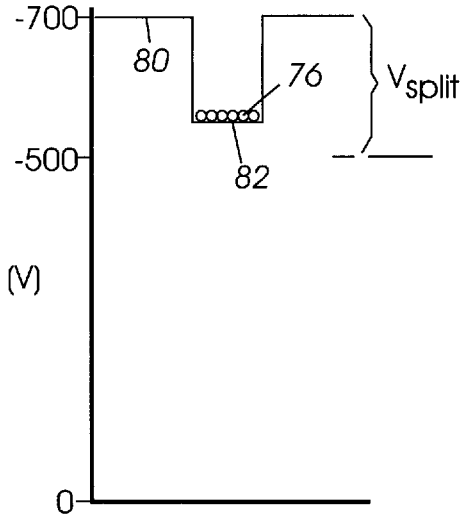
FIG. 5 shows a typical voltage profile of the image area after being recharged by a first recharging device.

FIG. 5 shows the voltages on the image area after it passes through the first recharging device 36. The first recharging device overcharges the image area to more negative levels than that which the image area is to have when it leaves the recharging station D. For example, as shown in FIG. 5 the toned and the untoned parts of the image area, reach a voltage level 80 of about −700 volts. The first recharging device 36 is preferably a DC scorotron.

Figure 6:
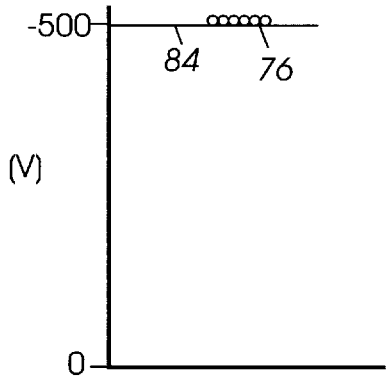
FIG. 6 shows a typical voltage profile of the image area after being recharged by a second recharging device.

After being recharged by the first recharging device 36, the image area passes to the second recharging device 37. Referring now to FIG. 6, the second recharging device 37 reduces the voltage of the image area, both the untoned parts and the toned parts (represented by toner 76) to a level 84 which is the desired potential of −500 volts.

Figure 7:
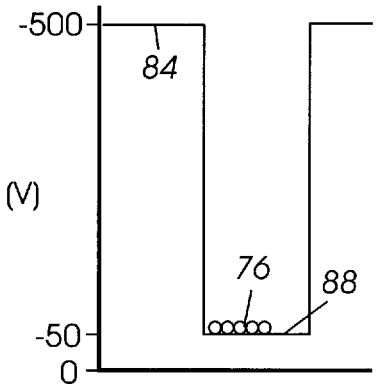
FIG. 7 shows a typical voltage profile of the image area after being exposed for a second time.

After being recharged at the first recharging station D, the now substantially uniformly charged image area with its first toner powder image passes to a second exposure station 38. Except for the fact that the second exposure station illuminates the image area with a light representation of a second color image (say yellow) to create a second electrostatic latent image, the second exposure station 38 is the same as the first exposure station B. FIG. 7 illustrates the potentials on the image area after it passes through the second exposure station. As shown, the non-illuminated areas have a potential about −500 as denoted by the level 84. However, illuminated areas, both the previously toned areas denoted by the toner 76 and the untoned areas are discharged to about −50 volts as denoted by the level 88.

The image area then passes to a second development station E. Except for the fact that the second development station E contains a toner which is of a different color (yellow) than the toner (black) in the first development station C, the second development station is beneficially the same as the first development station. Since the toner is attracted to the less negative parts of the image area and repelled by the more negative parts, after passing through the second development station E the image area has first and second toner powder images which may overlap.

The image area then passes to a second recharging station F. The second recharging station F has first and second recharging devices, the devices 51 and 52, respectively, which operate similar to the recharging devices 36 and 37. Briefly, the first corona recharge device 51 overcharges the image areas to a greater absolute potential than that ultimately desired (say −700 volts) and the second corona recharging device, comprised of coronodes having AC potentials, neutralizes that potential to that ultimately desired.

The now recharged image area then passes through a third exposure station 53. Except for the fact that the third exposure station illuminates the image area with a light representation of a third color image (say magenta) so as to create a third electrostatic latent image, the third exposure station 38 is the same as the first and second exposure stations B and 38. The third electrostatic latent image is then developed using a third color of toner (magenta) contained in a third development station G.

The now recharged image area then passes through a third recharging station H. The third recharging station includes a pair of corona recharge devices 61 and 62 which adjust the voltage level of both the toned and untoned parts of the image area to a substantially uniform level in a manner similar to the corona recharging devices 36 and 37 and recharging devices 51 and 52.

After passing through the third recharging station the now recharged image area then passes through a fourth exposure station 63. Except for the fact that the fourth exposure station illuminates the image area with a light representation of a fourth color image (say cyan) so as to create a fourth electrostatic latent image, the fourth exposure station 63 is the same as the first, second, and third exposure stations, the exposure stations B, 38, and 53, respectively. The fourth electrostatic latent image is then developed using a fourth color toner (cyan) contained in a fourth development station I.

To condition the toner for effective transfer to a substrate, the image area then passes to a pretransfer corotron member 50 which delivers corona charge to ensure that the toner particles are of the required charge level so as to ensure proper subsequent transfer.

After passing the corotron member 50, the four toner powder images are transferred from the image area onto a support sheet 52 at transfer station J. It is to be understood that the support sheet is advanced to the transfer station in the direction 58 by a conventional sheet feeding apparatus which is not shown. The transfer station J includes a transfer corona device 54 which sprays positive ions onto the backside of sheet 52. This causes the negatively charged toner powder images to move onto the support sheet 52. The transfer station J also includes a detack corona device 56 which facilitates the removal of the support sheet 52 from the printing machine 8.

After transfer, the support sheet 52 moves onto a conveyor (not shown) which advances that sheet to a fusing station K. The fusing station K includes a fuser assembly, indicated generally by the reference numeral 60, which permanently affixes the transferred powder image to the support sheet 52. Preferably, the fuser assembly 60 includes a heated fuser roller 62 and a backup or pressure roller 64. When the support sheet 52 passes between the fuser roller 62 and the backup roller 64 the toner powder is permanently affixed to the sheet support 52. After fusing, a chute, not shown, guides the support sheets 52 to a catch tray, also not shown, for removal by an operator.

After the support sheet 52 has separated from the photoreceptor belt 10, residual toner particles on the image area are removed at cleaning station L via a cleaning brush contained in a housing 66. The image area is then ready to begin a new marking cycle.

The various machine functions described above are generally managed and regulated by a controller which provides electrical command signals for controlling the operations described above.

Figure 8:
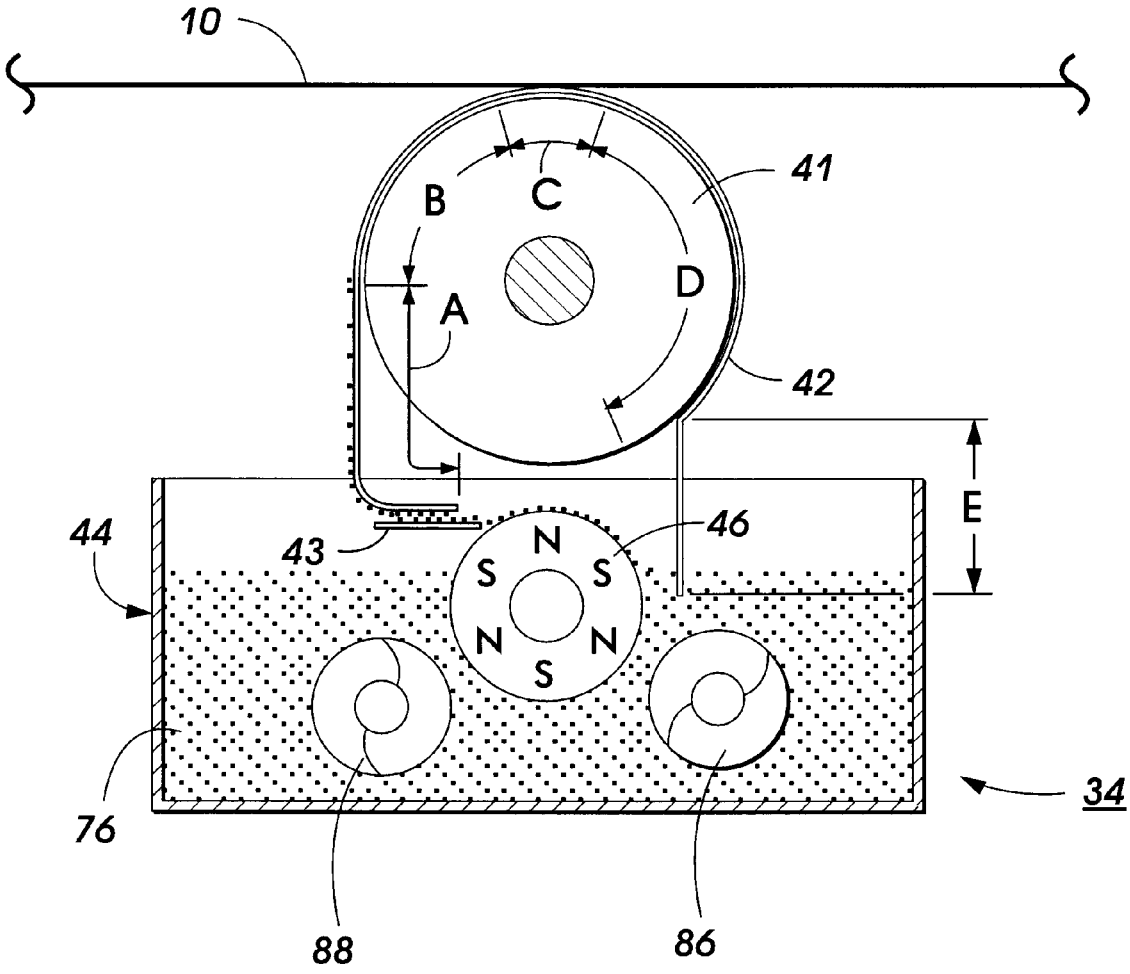
FIG. 8 is a schematic elevational view showing the development apparatus used in the FIG. 1 printing machine.

Turning to FIG. 8, which illustrates the development system 34 in greater detail, development system 34 includes a housing 44 defining a chamber 76 for storing a supply of developer material therein. Donor belt 42 is mounted on stationary roll 41 and belt portion 43 is mounted adjacent to mag roll 46.

Donor belts 42 and 43 comprise a flexible circuit broad having finely spaced electrode array 200 thereon as shown in FIGS. 9 and 10. The electrode array 200 has a four phase grid structure consisting of electrodes 202, 204, 206 and 208 having a voltage source operatively connected thereto in the manner shown in order to supply AC or DC voltage in the appropriate electrode area groups A–F.

It is preferred to have the spacing between each electrode equal to the width of each electrode. The spacing of electrodes is preferably 100 $\mu$m preferred width of each electrode is 100 $\mu$m. The preferred flexible circuit broad consist of a 2 mil thick polyimide film having metal electrodes such as Cu, preferably the thickness of the electrodes is 5 to 8 microns.

Loading of Toner onto Donor Belt

Figure 13:
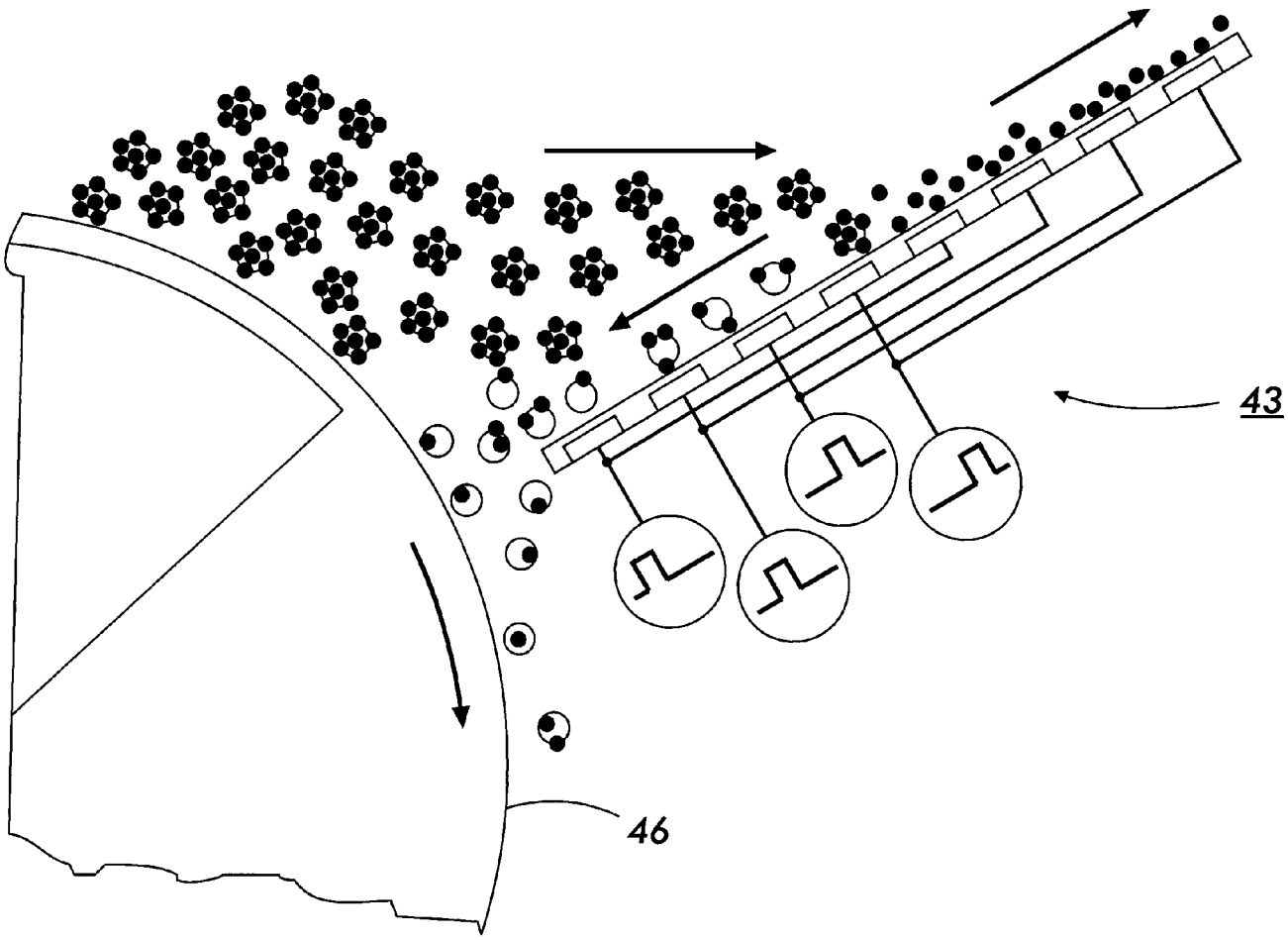
FIG. 13 illustrates toner load on the flexible donor belt.

The present invention employs a controlled cascade loading of toner from a two component developer to keep a high density of developer near the surface of the grid while providing a gentle loading zone to minimize device wear. Electric fields generated on the grid are designed to be the same order of magnitude as those required for the development of xerographic latent images for example, there is a contrast voltage of from 200 to 800 volts applied between electrodes on the pickup grid 43 in FIG. 8 which is part of the traveling wave signal and thus enables toner to be separated from the carrier in a manner similar to normal xerographic development. By more closely matching the speed of the developer with the phase velocity of the wave allows more time for toner to be stripped from developer beads thus improving the toner density on the traveling wave grid. The cascade mode will also allow a higher density of carrier beads near the grid surface. By loading in a manner of FIG. 13 Mag roll 46 cascades toner onto belt portion 43. The first portion of the belt 43 transfers toner to belt 42 via a net DC potential difference maintained between belt 42 and 43 (V2-V1) which is in the neighborhood of 200–400 Vdc for example. This field is in a direction to insure toner transfers to belt 42 and the carrier beads do not. This approach also filters toner and produces very little wrong sign toner to member 42 which increases the reliability of the system.

The magnetic roller 46 rotates at a rate such that the surface velocity is close to the phase velocity of the electrostatic wave applied to belt element 43. Developer cascades at a velocity close to the phase velocity of the traveling wave which is approximately equal to the frequency of the driving waveform ,v, multiplied by the phase number (4 for a four phase device) multiplied by the traveling wave electrode width plus electrode spacing. Of course, other approaches could be used to introduce the developer onto the grid device 43.

Power source 220 applies an electrical bias between on electrodes 202, 204, 206 and 208. In electrodes group area A, for example, are DC bias from 200V to 800V is applied to electrodes 202, 204, 206 and 208 at a frequency for example of 1000 hz. to move the toner.

Transporting of Toner to Development Zone

In electrode group area B, electrodes 202, 204, 206 and 208 are phase with a DC traveling wave (500V to 1000V) to transport toner to the development zone. A typical operating frequency is between 2 Khz to 5 Khz. The traveling wave can be a square waveform or a sine waveform, however a square waveform is preferred. The force f required for moving toner is F=QE, where $E_f$, is the tangential field supplied by the multi phase system at any time $E_f$=(1/d)(Vph1−Vph2) in this equation, d is the spacing between the two electrodes and is usually fixed. Vph1 and Vph2 are the voltages of the two adjacent electrodes respectively and vary as a function of time.

For the case of a Sine wave, for a Peak AC voltage VP the resulting E field is equal to (1/d)[VpSin(wt)+Vpsin(wt+P)] where P is the phase difference between the two voltage waveform. The maximum electric field depends on the phase of the waveform. The E field is largest when the phase between the two waveforms is equal to 180 degrees. And in this case the it is equal to 2VP/d.

Charging of Toner

Figure 14:
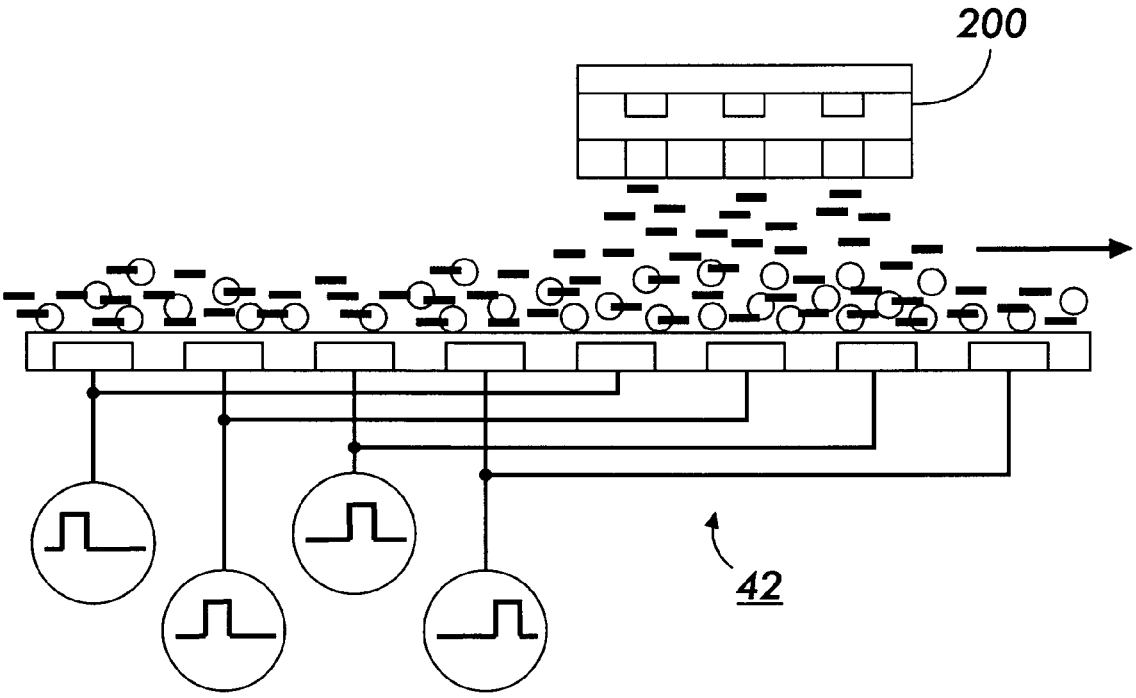
FIGS. 14 and 15 illustrate charging of toner on the flexible donor belt.
Figure 15:
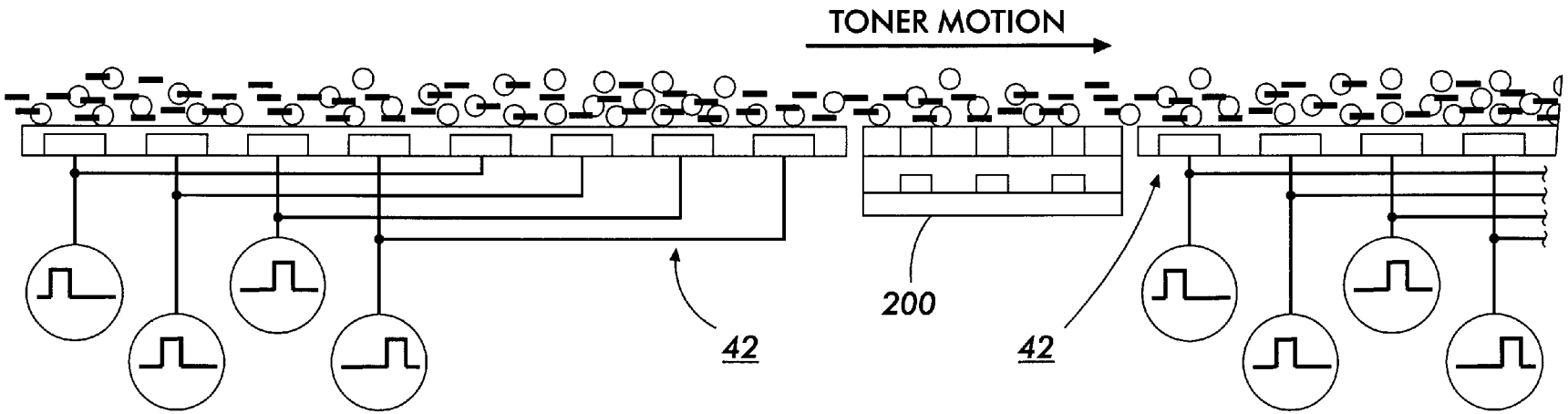

There is a precharge step which consists of a conventional magnetic brush to precharge the toner to enable travel on the grid. The ion charging device 200 then steps up the charge and gives the toner a uniform and controllable charge for the development step. FIG. 14 shows a toner being charged by passing under charging device 200. FIG. 15 shows another approach of an in-line design using toner momentum to carry toner across the surface of charging device 200 which is incorporated into the travel wave grid. Preferably, charging devices employed is a Microtron or SSC (Solid State Charging) devices as described in U.S. Pat. No. 5,563,688 which is hereby incorporated by reference.

The advantages of this combined device include (as shown in FIG. 15): small size, ability to handle a wide range of toners (charging independent of toner composition); Flexibility to adapt to many machine architectures, ability to alter and control charge on toner as a process control variable in response to environmental changes.

Developing the Image in the Development Zone

Applicants have found that high quality development requires that the toner cloud be in a state which will enable it to be captured by fine details of the latent electrostatic image, the field lines of which are very local to the imaging surface. Toner transporting at too high a velocity or too close to the transport grid will not be picked up in the image. The way we accomplish high quality development for mechanical donor roll powder cloud systems is to apply an AC field between the donor and the photoreceptor backplane to move the toner cloud closer to the image (donor AC) as well as controlling the extent of the development zone.

An aspect of the present invention here is an application a separate AC and DC field component to electrodes in the development zone in addition to or in place of the transporting field to control development characteristics allowing fine detail development and low scavenging of previously developed image separations in the case of the IOI color imaging process.

An electrostatic traveling wave offers the possibility of moving charged toner without moving parts to a stationary development member allowing scavengeless powder cloud development while eliminating motion problems in this sensitive area. One of the problems with this approach is the requirement for transport of toner is essentially different from the requirements in the development zone. If one tries to find a compromise in the frequency of the applied signal one constrains the problem unnecessarily making the device difficult if not impossible to engineer. In the present invention the creation of different zones allowing application of different signals gives the device flexibility to perform both functions simultaneously with minimal compromise to either.

Figure 16:
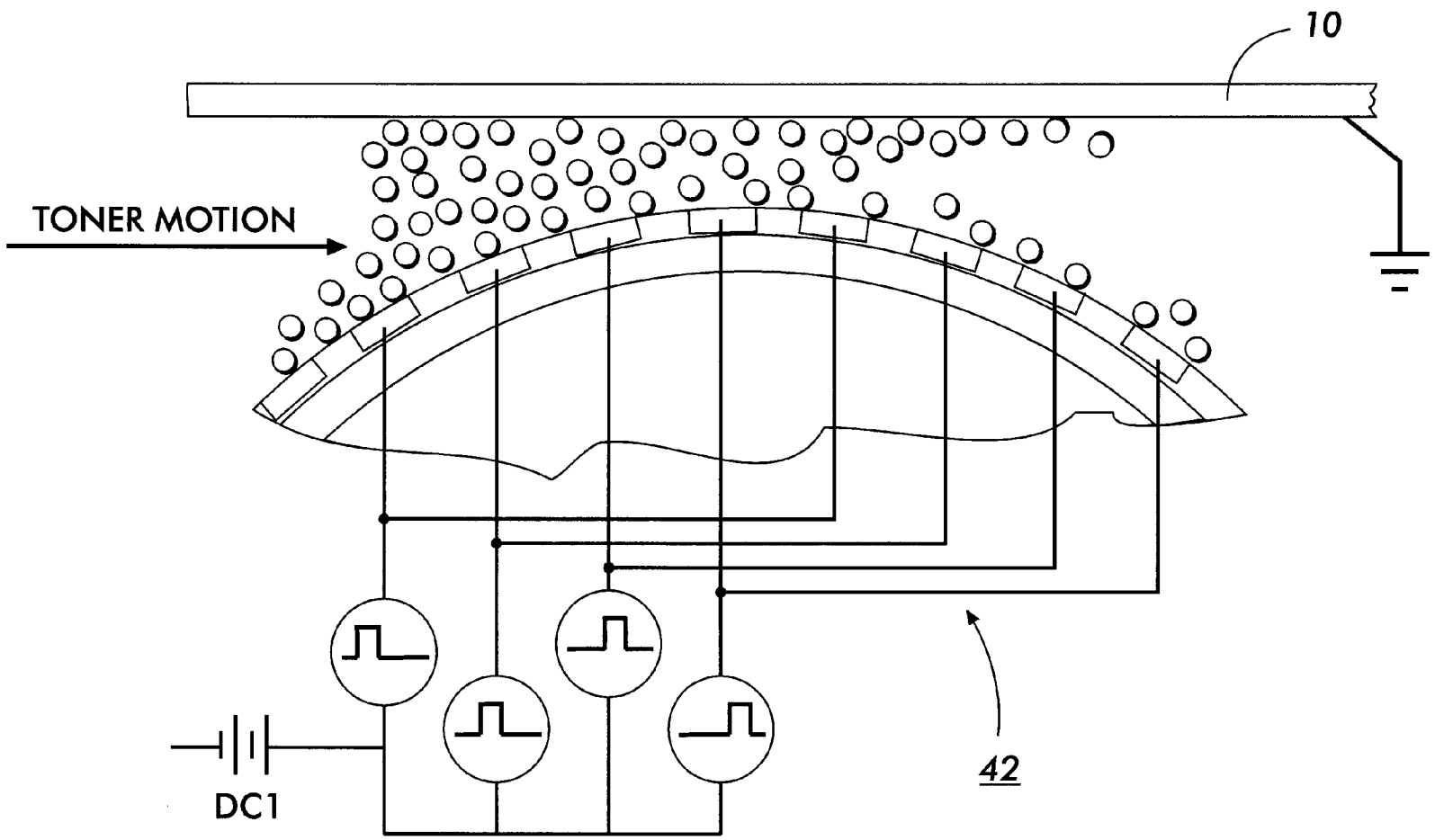
FIG. 16 PRIOR ART
FIGS. 16 and 17 illustrate development of the image on the photoconductor.

FIG. 16 shows a problem seen experimentally as toner starts to move toward the image early because of the common bias on all the grid lines. A pileup at the nip entrance occurs which gets worse as the spacing between grid and photoreceptor decreases. Attempts to pull in fine lines by increasing the DC development field or decreasing the p/r-grid gap will worsen this situation by making prenip toner density higher producing more of a pileup which will leave toner in non-image areas (background) and damage previously developed separations in an IOI color imaging process.

Figure 17:
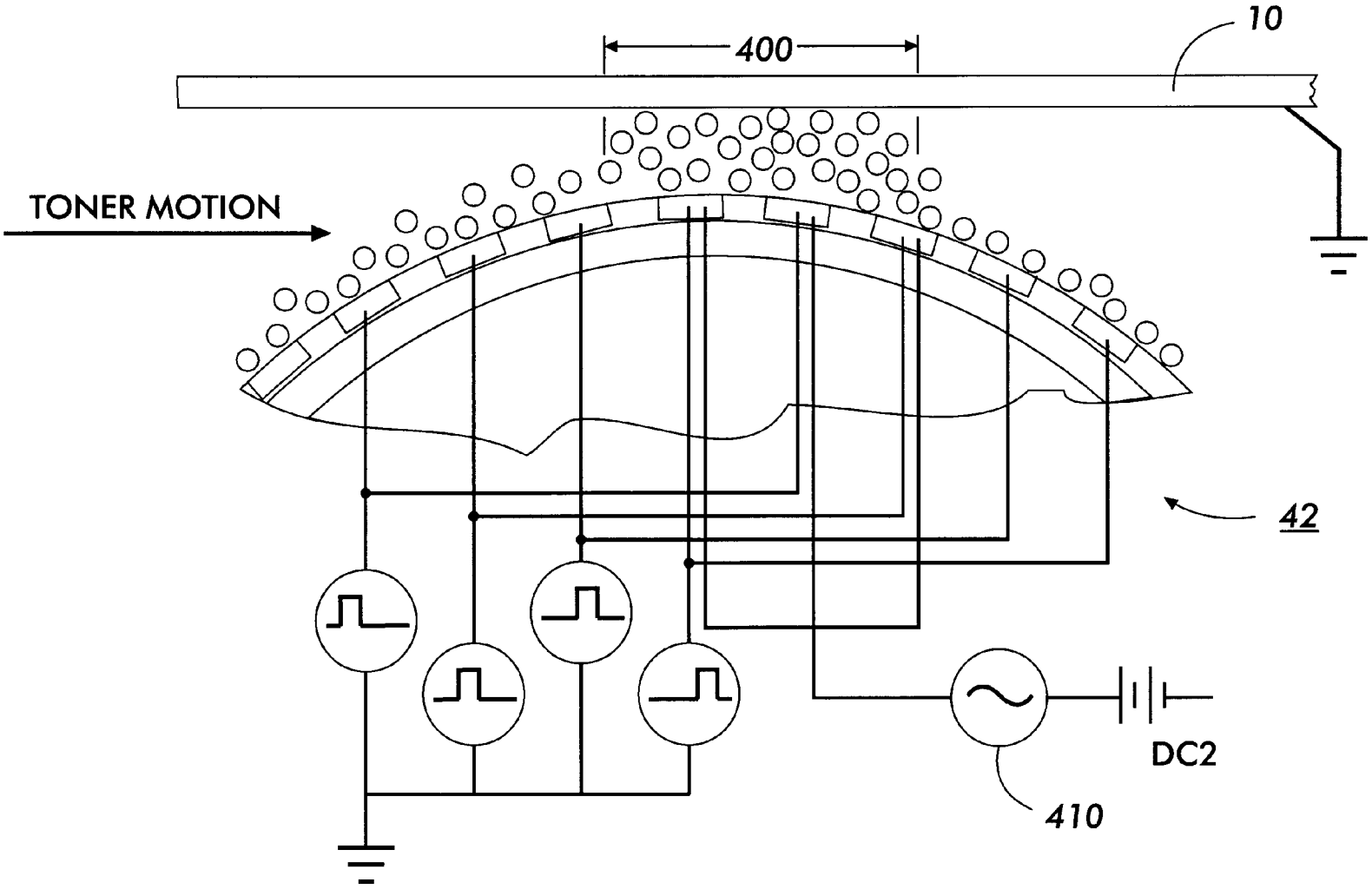

FIG. 17 shows an example of the proposed invention, a multizone grid structure. In this case the base traveling wave signal is applied to the entire grid but in the development zone 400 we also apply an AC signal 410 between the grid and backplane of the photoreceptor (for example 500 hz at 200 volts peak) and separate DC signal. We delineate a development zone to control where the development process starts, thus eliminating the prenip problems and also allowing for different electrostatic fields to control line development and scavenging in IOI systems. The net effect will be a reservoir of toner in the development region similar to current state of the art powder cloud systems. We essential slow down toner traveling on the device moving it into a classic "curtain mode" and allow toner to be captured more easily from the toner cloud on the traveling wave device. This is essentially different from previously attempted traveling wave development devices and will produce a dense cloud in the development zone.

This approach uses our knowledge of powder cloud development systems and extends it to a traveling wave device with the added advantage of having no mechanical motion or seams in the development zone to introduce defects commonly seen with donor roll systems.

Transporting of Toner to the Unloading Zone

The transportation of toner to the unloading zone is identical to the transportation of toner to the development zone in which electrodes group area D are also phased DC to transport toner to the unload zone.

Unloading Toner from Belt

Electrodes in group area E are biased relative to the donor belt so that toner is repelled from the surface thereof to the two component developer sump where toner can be mixed back into the system for reuse.

Other embodiments and modifications of the present invention may occur to those skilled in the art subsequent to a review of the information presented herein; these embodiments and modifications, as well as equivalents thereof, are also included within the scope of this invention.

What is claimed is:

1. An apparatus for developing a latent image recorded on an imaging surface, comprising:

a housing defining a chamber storing a supply of developer material comprising toner;

a donor member, spaced from the imaging surface, for transporting toner on the surface thereof to a region opposed from the imaging surface, said donor member includes an electrode array on the outer surface thereof, said array including a plurality of spaced apart electrodes extending substantially across width of the surface of the donor member;

a multi-phase voltage source operatively coupled to said electrode array, the phase being shifted with respect to each other such as to create an electrodynamic wave pattern for moving toner particles to and from a development zone; and a charging device for charging toner on the surface of said donor member.

2. The apparatus of claim 1, wherein said charging device is disposed adjacent to the surface of said donor member.

3. The apparatus of claim 1, wherein said charging device is disposed along the surface of said donor member.

4. The apparatus of claim 1, wherein said charging device is a solid state charging device.

5. A method for charging toner on a donor member, comprising the steps of:

transporting toner along the surface of said donor member with an electrodynamic wave pattern; and charging the toner with a charging device while the toner is being transported along the surface of the donor member.

6. The method of claim 5, wherein charging step includes transporting toner across said surface of said charging device.

* * * * *